United States Patent [19]

Moneta

[11] Patent Number: 4,685,484

[45] Date of Patent: Aug. 11, 1987

[54] WIND SHELTER

[76] Inventor: Ted C. Moneta, 1115 S. Wooster St., #206, Los Angeles, Calif. 90035

[21] Appl. No.: 775,531

[22] Filed: Sep. 13, 1985

[51] Int. Cl.[4] ..... E04H 15/58; E04H 15/02; E06B 3/12; A47G 5/00

[52] U.S. Cl. ..... 135/117; 135/900; 135/DIG. 9; 160/234; 160/351

[58] Field of Search ..... 135/117, 900, 901, 902, 135/903, 118, 119, 114; 160/135, 327, 328, 234, 351; 16/291, 297

[56] References Cited

U.S. PATENT DOCUMENTS

| | | | |
|---|---|---|---|
| 842,519 | 1/1907 | Brothers | 16/291 |
| 1,238,646 | 8/1917 | Dennis | 135/112 X |
| 1,662,586 | 3/1928 | Newman | 160/351 |
| 1,713,439 | 5/1929 | Klyaich | 135/902 X |
| 1,803,626 | 5/1931 | Lasley | 135/902 X |
| 1,830,282 | 11/1931 | Lorch | 160/351 |
| 2,335,274 | 11/1943 | Hampton | 135/900 X |
| 2,771,088 | 11/1956 | Soldan | 135/903 X |
| 3,423,095 | 1/1969 | Cox | 446/901 X |
| 3,503,101 | 3/1970 | Kolozsvary | 135/119 X |
| 3,833,964 | 10/1974 | Harcourt | 16/291 |

FOREIGN PATENT DOCUMENTS

| | | | |
|---|---|---|---|
| 527450 | 10/1940 | United Kingdom | 135/114 |

OTHER PUBLICATIONS

Velcro Product News, 8-1978, New York, N.Y., 135-104.

*Primary Examiner*—Robert A. Hafer
*Assistant Examiner*—D. Neal Muir
*Attorney, Agent, or Firm*—Bruce L. Birchard

[57] ABSTRACT

An improved wind shelter with an arm mechanism which urges arm segments interconnecting adjacent posts into a horizontal, aligned and opposing position when the wind shelter is in use and which urges such arm segments towards a position in which they are contiguous along their lengths when the wind shelter is collapsed for transportation, the fabric of the wind shelter having parallel pockets for receiving posts and an upper flap portion for removably attaching the fabric to the posts.

3 Claims, 5 Drawing Figures

WIND SHELTER

BACKGROUND OF THE INVENTION

1. Field of the Invention

This invention relates to wind shelters and more specifically to wind shelters for use at the beach or in similar outdoor environments.

2. Prior Art

While there are numerous issued patents in the prior art covering wind shelters, they all suffer from the problem of difficulty and complexity in erection of the wind shelter at the using site. For example, the wind shelter of U.S. Pat. No. 4,407,319 requires the attachment of ballast containers 22, 24 and 26. Further, the structure of the '319 patent is relatively rigid and not totally collapsible for ease of carrying. It is desirable to have a structure which contains a mechanism to produce automatic stretching of the wind shelter fabric into a form which can resist the winds from which protection is sought and which will, when the use of the wind shelter has been completed, automatically, or, at least, with little urging, collapse into a very compact package which may be easily transported.

Therefore, it is the object of this invention to provide an improved wind shelter which automatically forms itself into the desired shape, when it is being erected, and which automatically assists in the collapsing of the wind shelter when its use has been completed.

It is a further object of this invention to overcome the difficulties and problems associated with the prior art devices.

SUMMARY OF THE INVENTION

Stated succinctly, a lightweight, low cost, collapsible, and easily usable wind shelter is provided by spring biasing inter-coupled cross arms to a horizontal position and providing a toggling mechanism in the inter-connection between cross-arm segments so that, when the cross-arm segments are in the horizontal position (in opposition to each other) they are held stably in that position by the toggling mechanism which must be overridden in order to remove the cross-arm segments from the horizontal mode during the collapsing of the wind shelter for transportation purposes. The inter-connecting toggling mechanism, once the horizontal mode has been rejected by the user in favor of collapsing the wind shelter, urging the supporting posts or poles for the wind shelter toward each other, resulting in a compact package once the shelter is totally collapsed, thereby assuring easy transportation. Additional stability of the wind shelter is assured by means of fasteners securing the upper extremity of the fabric in the wind shelter, removably, from the supporting posts or poles.

BRIEF DESCRIPTION OF THE DRAWINGS

This invention both as to its objectives and the means by which those objectives are achieved, can best be understood by the description which follows taken in conjunction with their drawing, in which.

DETAILED DESCRIPTION OF THE PREFERRED EMBODIMENTS

Figure 1:
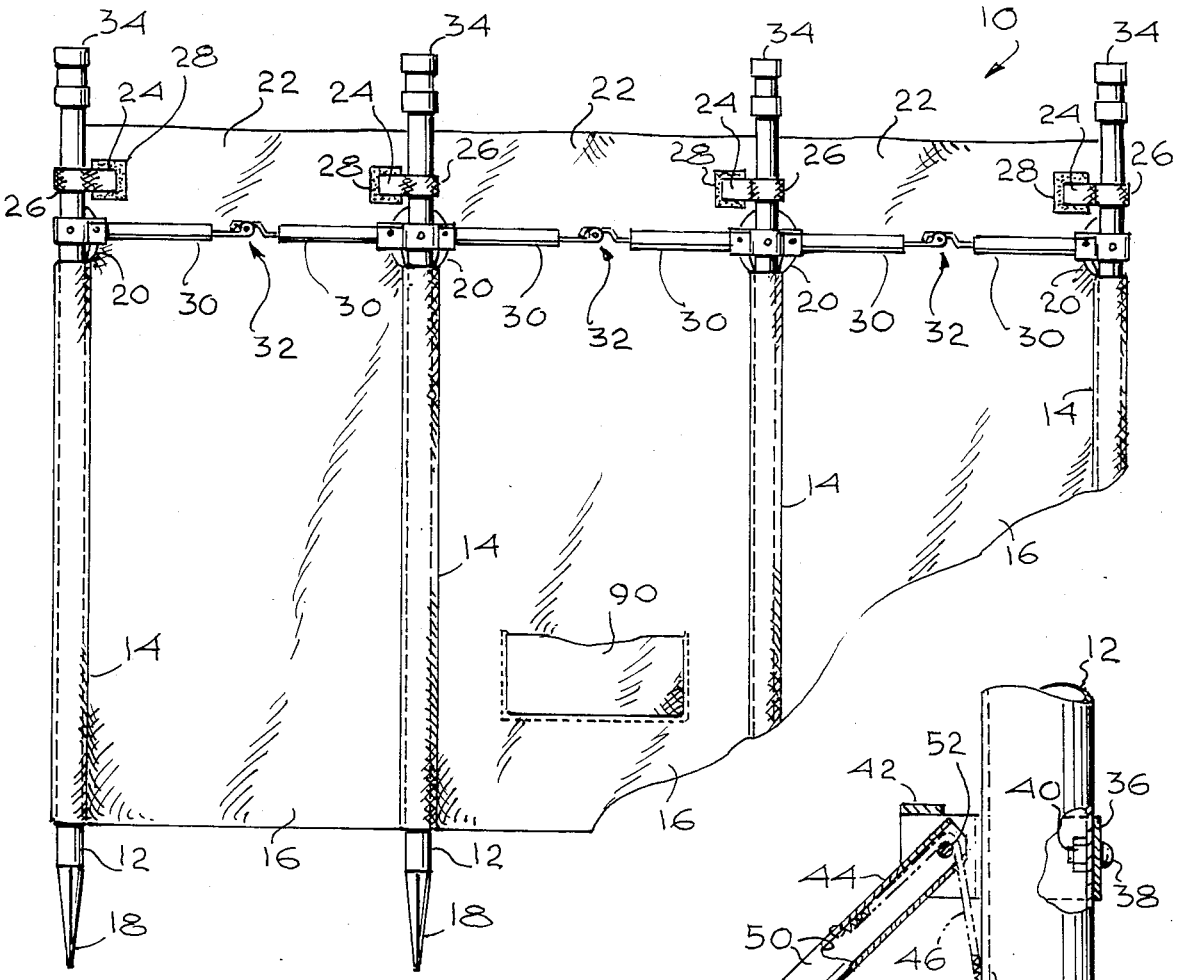
FIG. 1 is an elevational view of an improved wind shelter, according to my invention.

In FIG. 1 wind shelter 10 has poles or posts 12 which are received by pockets 14 in fabric 16. Poles or posts 12 have pointed ends 18 to make easier the insertion of poles 12 into the sand or other earth at the site where the wind shelter 10 is to be used. Pockets 14 terminate, at their upper ends, in edges 20. The portions 22 of fabric 16 above edges 20 of pockets 14 are referred to herein as the upper extremities of fabric 16, such upper extremities of fabric 16 being held in place by means of straps 24 permanently secured at one end 26 to fabric 16 and removably attached to securing pads 28 by reason of Velcro-type fastening materials carried by pads 28 and the cooperating ends of straps 24.

Figure 4:
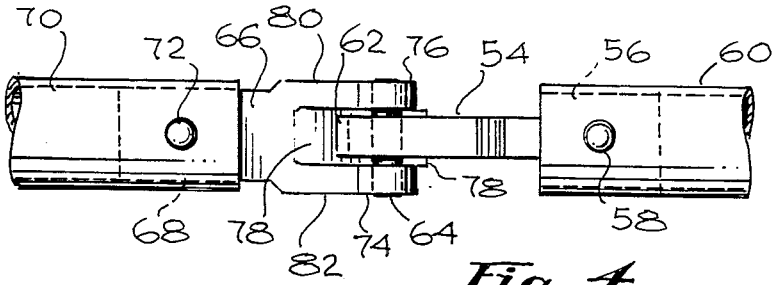
FIG. 4 is a top view of the mechanism of FIG. 3.
Figure 5:
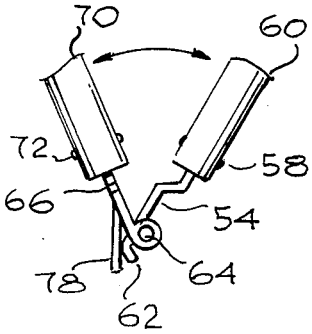
FIG. 5 is an elevational view of the mechanism of FIG. 3 in an alternative mode.

Inter-coupling the various poles or posts 12 are horizontal arm segments 30 which are, themselves, inter-coupled in pairs by means of toggling mechanism 32, the details of which may be seen more clearly in FIGS. 4 and 5. Pairs of horizontal arm segments 30 are coupled, at the opposite ends of each pair, to posts or poles 12 in rotatable fashion, being biased to the horizontal position by a mechanism which can be seen more clearly in FIG. 2.

The upper ends of poles 12 carry grips 34 which assist the operator or user in inserting poles 12 into the soil or sand at the site where the shelter is to be used.

Figure 2:
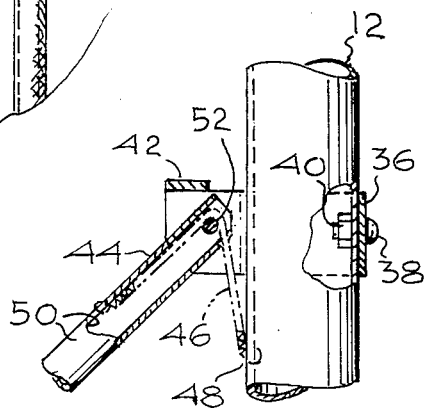
FIG. 2 is a mechanical schematic diagram showing a portion of the mechanism of the improved wind shelter of FIG. 1.

In FIG. 2, pole or post 12 has a strap 36 secured to it at the appropriate height by means of machine screw 38 and an associated nut 40 which passes through the wall of post 12. Strap 36 has a stop 42 which is engaged by horizontal arm segment 44 when segment 44 is in an appropriate horizontal position, as urged by biasing spring 46. Biasing spring 46 is secured at one end 48 to post 12 and at the other end rests in forceful fashion upon the inner surface 50 of horizontal arm segment 44, urging it upwardly about shaft 52 which acts as a retainer for the biasing spring 46 and also acts as an axis for the rotation of horizontal arm segment 44 within strap 36.

Figure 3:
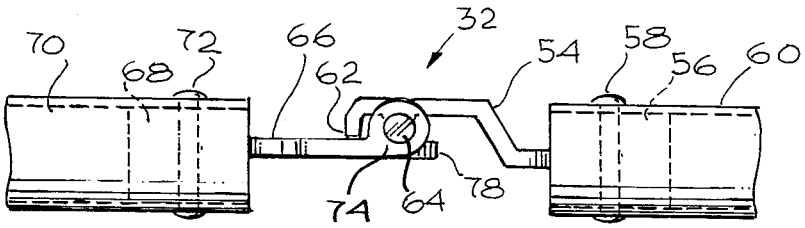
FIG. 3 is an enlarged view of a portion of the improved wind shelter of FIG. 1.

Toggling mechanism 32 is shown in more detail in FIGS. 3–5. In FIG. 3, which shows an elevational view of the toggling mechanism, toggle-arm 54 is secured at one end to plug 56 which is, in turn, secured by a bolt 58 in first horizontal arm segment 60. Toggle arm 54 has a toggling tip portion 62 and a shaft 64 which is supported from toggle arm 54 at right angles to that toggle arm. Yoke member 66 is supported by plug 68 in second horizontal arm segment 70 in which it is secured by means of machine screw or other fastening member 72. Yoke member 66 terminates, at its end remote from plug 68, in a pair of journals 74, 76 which receive shaft 64 of toggle-arm 54 for relative rotation between shaft 64 and yoke 66. Yoke member 66 includes a central, resilient member 78 which snugly engages end 62 of toggle-arm 54. If toggling mechanism 32 is pushed downwardly, as occurs when wind shelter 10 is being collapsed for transportation, tip 62 of toggle-arm 54 forcefully engages resilient element 78 in yoke 66 and forces it from its original position parallel with segments 80, 82 of yoke member 66 into a position such as that shown in FIG. 5. Once toggle-arm 54 passes the position when toggle 54 is normal to resilient member 78, that resilient member 78 forces horizontal arm segment 60 to rotate about axle 64 towards a position where horizontal arm segment 60 is contiguous, along its length, with horizontal arm segment 70. In that process, the pole 72 associated with these respective horizontal arm segments are brought to a position adjacent each other. Thus, when wind shelter 10 is collapsed, it may be easily transported.

When wind shelter 10 is to be erected, the two adjacent poles are pulled apart against the biasing force of resilient member 78 until toggle-arm 54 once again passes the point where it is normal to resilient element 78 following which any additional opening motion between adjacent poles will be aided by the force of resilient member 78 on toggle-arm 54, until horizontal arm segments 60 and 70 are horizontal and opposing each other, at which time the biasing action of resilient element 78 ceases.

Thus the opening and collapsing of wind shelter 10 is materially aided by the toggling mechanism 32 as well as by the biasing mechanism between each pole and its associated horizontal arm segment 44, as shown in FIG. 2.

Wind shelter 10 may have one or more pockets 90 provided on its fabric surface to accommodate magazines and other articles carried to the beach or other sites for use in the wind shelter according to my invention.

While a particular embodiment of my invention has been shown and described, it will be apparent to those skilled in the art that variations and modifications may be made therein without departing from the spirit or scope of my invention. It is the intention of the appended claims to cover all such variations and modifications.

I claim:

1. An improved wind shelter including a plurality of posts, said posts having top and bottom portions, said bottom portions being pointed, said top portions having hand grips at the upper extremities thereof;

an arm mechanism interconnecting adjacent posts in said wind shelter, said arm mechanism including first and second arm segments, each of said first and second arm segments having a first and second end;

a toggling mechanism interconnecting said second end of said first arm segment to said first end of said second arm segment;

a strap mechanism pivotably supporting each of said first end of said first arm segment and said second end of said second arm segment from respective adjacent posts in said wind shelter;

said strap mechanism including biasing means for biasing said first and second arm segments into an opposed and aligned position with respect to each other;

said toggling mechanism including means for urging said first and second arm segments into an opposed and aligned position when said shelter is in use and towards a position with said arm segments folded and adjacent along their lengths, when said wind shelter is collapsed for transportation; and, fabric means, said fabric means including a pocket portion and a flap portion;

said pocket portion including pockets for receiving said posts and extending substantially the full length of each of said posts, said flap portion including retainer means for securing said flap portion to said top portion of each of said posts.

2. Apparatus according to claim 1 in which said strap means includes stop means for limiting the pivoting motion of said arm segments.

3. Apparatus according to claim 1 in which said retainer means includes a Velcrotype fastener.

* * * * *